US011536512B1

(12) United States Patent
Harkins, Jr.

(10) Patent No.: US 11,536,512 B1
(45) Date of Patent: Dec. 27, 2022

(54) APPARATUS AND METHOD FOR LYOPHILIZATION

(71) Applicant: Thomas John Harkins, Jr., Whaleyville, MD (US)

(72) Inventor: Thomas John Harkins, Jr., Whaleyville, MD (US)

( * ) Notice: Subject to any disclaimer, the term of this patent is extended or adjusted under 35 U.S.C. 154(b) by 0 days.

(21) Appl. No.: 17/588,349

(22) Filed: Jan. 31, 2022

Related U.S. Application Data

(60) Provisional application No. 63/245,068, filed on Sep. 16, 2021, provisional application No. 63/245,062, filed on Sep. 16, 2021.

(51) Int. Cl.

| | |
|---|---|
| ***F26B 5/06*** | (2006.01) |
| ***F26B 25/00*** | (2006.01) |
| ***F26B 25/18*** | (2006.01) |
| ***A61J 1/14*** | (2006.01) |

(52) U.S. Cl.
CPC ..... *F26B 5/06* (2013.01); *A61J 1/14* (2013.01); *F26B 25/008* (2013.01); *F26B 25/18* (2013.01)

(58) Field of Classification Search
CPC . F26B 5/06; F26B 25/008; F26B 25/18; A61J 1/14
USPC ..... 34/92, 284
See application file for complete search history.

(56) References Cited

U.S. PATENT DOCUMENTS 3,795,986 A * 3/1974 Sutherland ..... F26B 5/06 34/92
3,817,259 A * 6/1974 Strasser ..... A24B 3/182 131/297
4,127,947 A * 12/1978 Webb ..... F26B 7/00 34/92
5,286,448 A * 2/1994 Childers ..... A61L 2/20 422/295
5,522,155 A * 6/1996 Jones ..... B65D 51/1683 34/286
5,596,814 A * 1/1997 Zingle ..... F26B 5/06 34/296
5,964,043 A * 10/1999 Oughton ..... F26B 5/06 34/92
6,122,836 A * 9/2000 Tenedini ..... F26B 5/06 34/92

(Continued)

FOREIGN PATENT DOCUMENTS

GB 1011475 A * 12/1965
JP 2012046250 A * 3/2012 ..... B01L 3/50825

(Continued)

*Primary Examiner* — Stephen M Gravini
(74) *Attorney, Agent, or Firm* — Smith Patent. LLC; Chalin A. Smith

(57) ABSTRACT

An apparatus and method for lyophilization, the apparatus includes a block made from a conductive material. The block has multiple wells dimensioned to receive containers wherein the depth of the wells is proportional to the length of the containers. A silicone pad covers the well and can secure the containers in the well. A metal plate can secure the silicone pad by fastening it to the block. The silicone plate and the metal plate can have vents to allow vapors from the containers to escape. The apparatus can be turned up to 90 degrees resulting in the turning of the containers from an upright position to a horizontal position. The container can be a syringe.

3 Claims, 5 Drawing Sheets

(56) References Cited

U.S. PATENT DOCUMENTS

| | | | | |
|---|---|---|---|---|
| 6,199,297 | B1 * | 3/2001 | Wisniewski | F26B 5/06 206/439 |
| 7,086,177 | B2 * | 8/2006 | Alstat | C02F 1/22 34/92 |
| 9,005,183 | B2 * | 4/2015 | Harkins, Jr. | A61K 31/19 604/82 |
| 9,222,728 | B2 * | 12/2015 | Py | F26B 5/06 |
| 9,435,586 | B2 * | 9/2016 | Ling | F26B 5/06 |
| 9,739,532 | B2 * | 8/2017 | Baugh | F26B 9/06 |
| 10,364,053 | B2 * | 7/2019 | Wensley | B65D 39/0023 |
| 10,443,935 | B2 * | 10/2019 | Knight | A01N 1/0252 |
| 2009/0001042 | A1 * | 1/2009 | Sever | B65D 51/241 215/277 |
| 2014/0183094 | A1 * | 7/2014 | Imai | A61J 1/2096 53/432 |
| 2018/0044076 | A1 * | 2/2018 | Eichhorn | A61J 1/1406 |
| 2018/0110922 | A1 * | 4/2018 | Dunki-Jacobs | A61M 5/19 |
| 2020/0223604 | A1 * | 7/2020 | Heinlein | A61K 9/19 |
| 2022/0110829 | A1 * | 4/2022 | Zwirnmann | A61M 5/345 |

FOREIGN PATENT DOCUMENTS

| | | | | |
|---|---|---|---|---|
| WO | WO-9527180 | A1 * | 10/1995 | F26B 5/06 |
| WO | WO-2019063772 | A1 * | 4/2019 | A61K 9/19 |

* cited by examiner

APPARATUS AND METHOD FOR LYOPHILIZATION

FIELD OF INVENTION

The present invention relates to an apparatus and method for lyophilization, and more particularly, the present invention relates to an improved lyophilization apparatus and method for lyophilization of pharmaceuticals.

BACKGROUND

Lyophilization is a well-known process and is universally accepted in many industries including chemical, pharmaceuticals, and food industries. The lyophilized products have certain advantages such as extended shelf-life and stability which makes the process popular. The process of lyophilization has been widely adopted in the pharmaceutical industry and more specifically for formulating the biologicals. Most of the biological preparations are temperature sensitive and thus have a short shelf life. Certain biological formulations, such as vaccines need to be stored at temperatures as low as −70 to −80°C. Equipment to maintain such low temperatures for storage and transportation are often not available. Lyophilized formulations, however, have a less temperature stringent requirement and can be stored at temperatures above 0° C., which can be easily maintained in normal refrigerators. Additionally, the lyophilized formulations have a long shelf life, and the dosage remains within specifications for a longer time. The lyophilized dosage forms can be readily solubilized for easy and dependable administration. Thus, lyophilization is exceptionally well suited for preserving and storing biological preparations because of the stability, extended shelf life, and requiring no refrigeration in transit or storage.

Lyophilization has traditionally been performed in containers, such as vials and ampules. Lyophilization is also performed directly in the syringe, and the lyophilized medication can be stored in the same syringe. However, convection and radiation are the common methods for heat transfer in the lyophilization process directly in injection syringes. Both convection and radiation are slow processes and lead to non-uniform heating in a batch of syringes being lyophilized. Vials on the other hand can be heated by combined conduction, convection, and radiation. Still, the heating of the vials is non-uniform. Presently, a typical radiation heat transfer is responsible for higher sublimation rates for vials or syringes located at the front and sides of an array. It is common for a batch to have fully mature hard product cake at the edges of the pan while the center of the batch is soft and raw.

Lyophilized pharmaceuticals in the syringe directly are stable and have a long shelf life. Moreover, it reduces the labor in preparation of the injections from vials. Also, wastage is reduced, and accurate dose can be administered. For administration, a diluent can be added to the syringe for reconstitution of the lyophilized product, and the medication can be administered from the syringe to the patient. As vaccines provided in multidose vials wane in demand and the single-dose vaccine becomes more preferred, lyophilized medicines are uniquely positioned by not requiring the burden of ultra-low temperature freezing on both shipment and storage at the destination.

Considering the increasing use of lyophilization in industry, a desire is always there for making the lyophilization process more efficient or reducing the product lyophilization cycle timeline, thus also making the process economical.

SUMMARY OF THE INVENTION

The following presents a simplified summary of one or more embodiments of the present invention in order to provide a basic understanding of such embodiments. This summary is not an extensive overview of all contemplated embodiments and is intended to neither identify key or critical elements of all embodiments nor delineate the scope of any or all embodiments. Its sole purpose is to present some concepts of one or more embodiments in a simplified form as a prelude to the more detailed description that is presented later.

This disclosure improves upon the current state of the art by utilizing an apparatus and methodology whereby lyophilization cycles can be shortened using novel design techniques and materials.

The principal object of the present invention is therefore directed to a lyophilization apparatus and method that has a shorter lyophilization cycle timeline.

It is another object of the present invention that the lyophilization method is efficient.

It is still another object of the present invention that the lyophilization method can be easily scaled up.

It is yet another object of the present invention that the lyophilizing process can be uniform in all units of a lyophilization batch.

In one aspect, disclosed is a lyophilization apparatus and method having optimized lyophilization cycle timelines and thereby shortened into more favorable timelines. The disclosed lyophilization apparatus can include a block made from heat conductive material. Preferably, the material can have high heat conductivity. The block can include wells arranged in several rows; the wells can receive containers for lyophilization. The containers can include products to be lyophilized.

In one aspect, the dimensions of the wells in the block can closely fit the containers such that heat can be uniformly transferred from the block to the containers and finally to the product in the containers.

In one aspect, also disclosed are the containers for lyophilization that can closely fit into the wells of the disclosed block. In one implementation of the containers, the containers can be syringes in which the product can be sterilized directly.

In one aspect, the containers can be square-shaped syringes and the wells of the block can also be square-shaped, such that the square-shaped containers can closely fit into the square-shaped wells.

BRIEF DESCRIPTION OF THE DRAWINGS

The accompanying figures, which are incorporated herein, form part of the specification and illustrate embodiments of the present invention. Together with the description, the figures further explain the principles of the present invention and to enable a person skilled in the relevant arts to make and use the invention.

DETAILED DESCRIPTION

Figure 1:
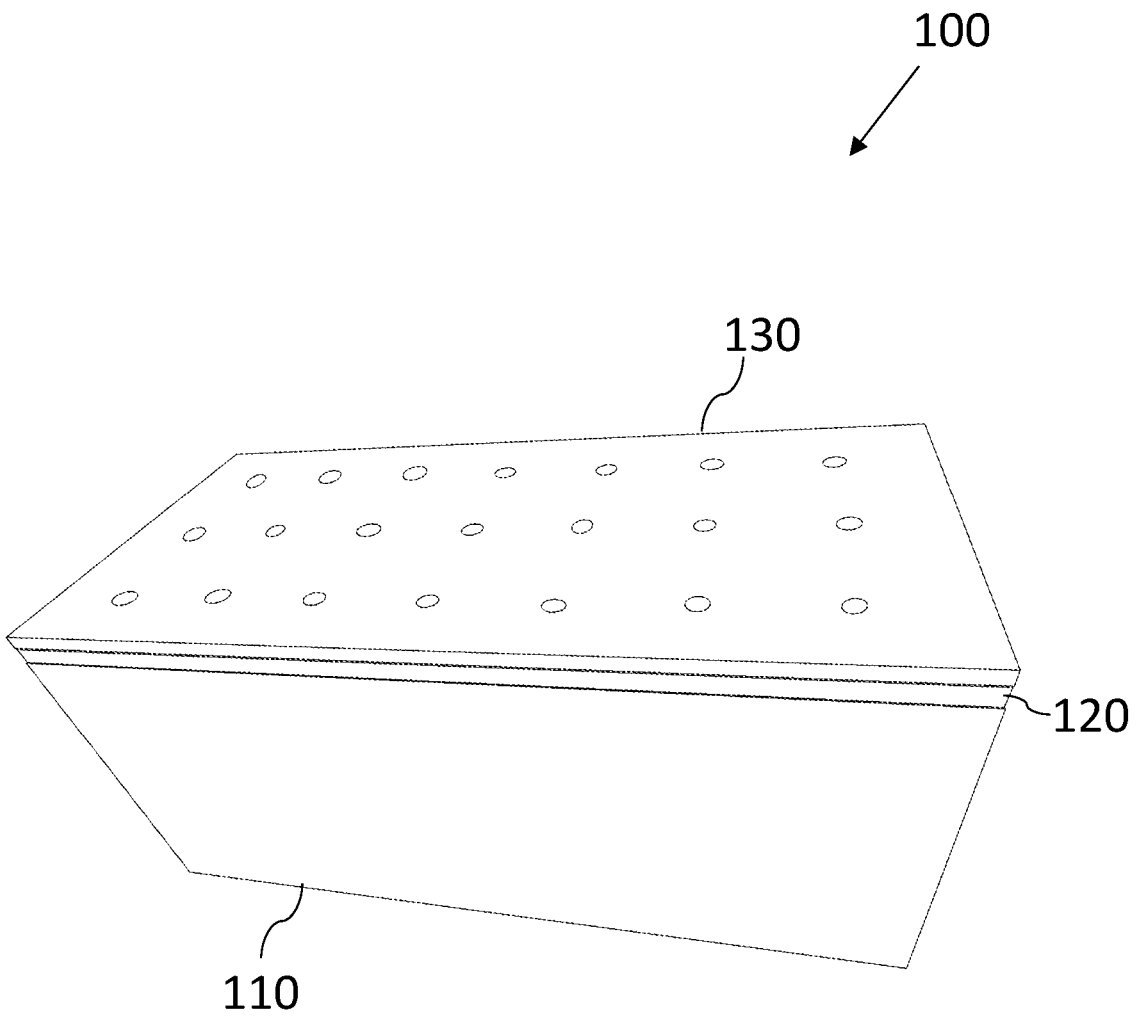
FIG. 1 is a perspective view of the lyophilization apparatus including a block, a silicone seal, and a vent plate, the silicone seal is shown sandwiched between the block and the seal, according to an exemplary embodiment of the present invention.
Figure 2:
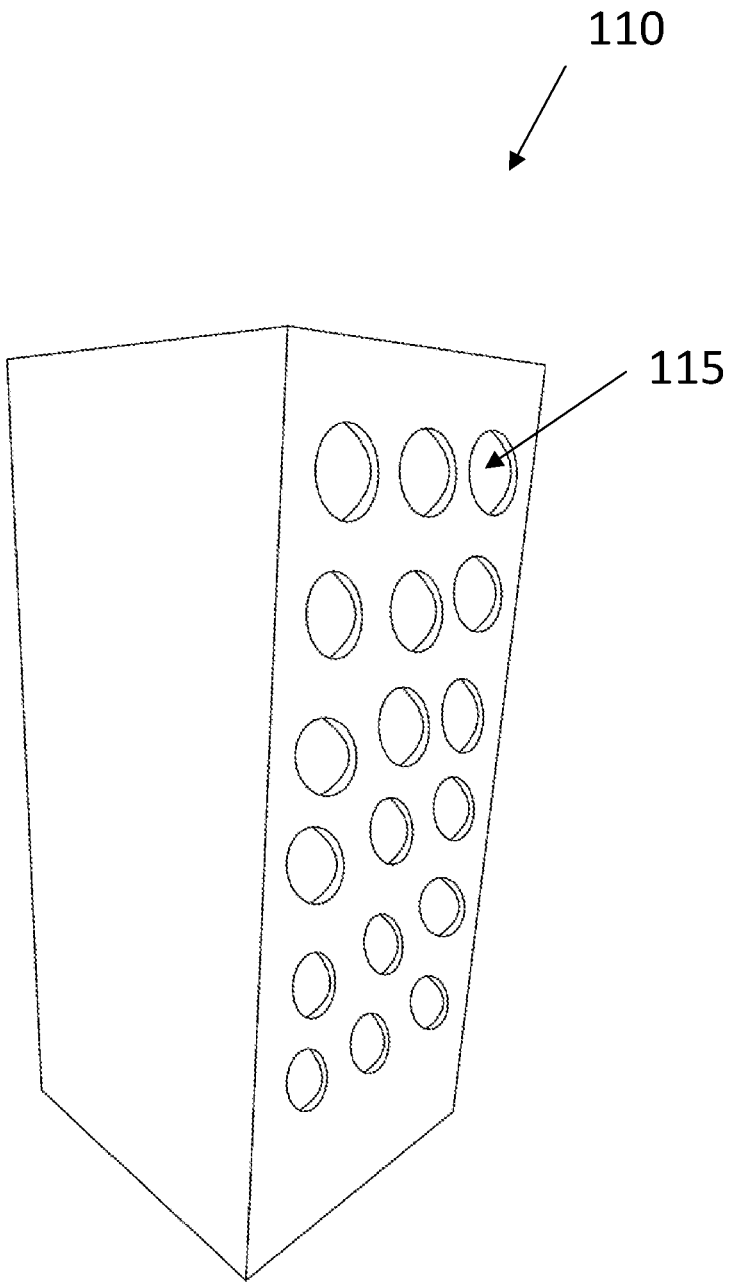
FIG. 2 shows the block, and wells in the block that are arranged in two rows, according to an exemplary embodiment of the present invention.
Figure 3:
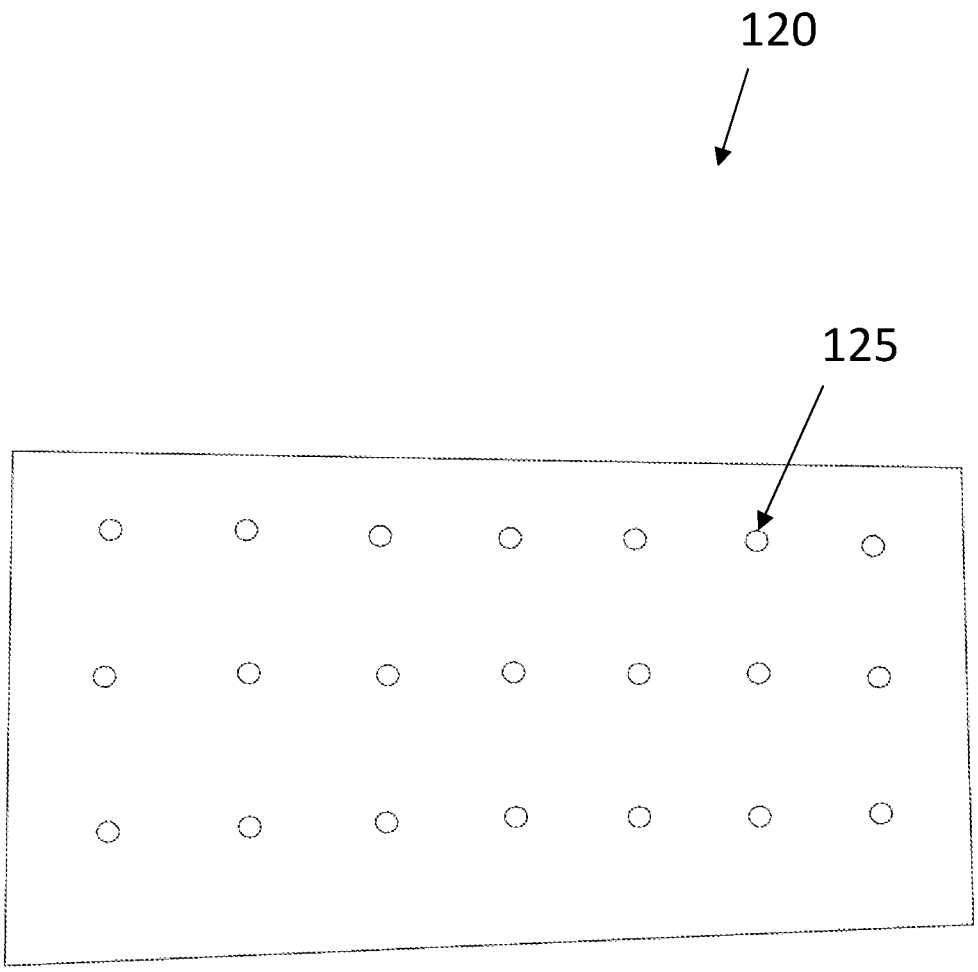
FIG. 3 shows the silicone seal, according to an exemplary embodiment of the present invention.
Figure 4:
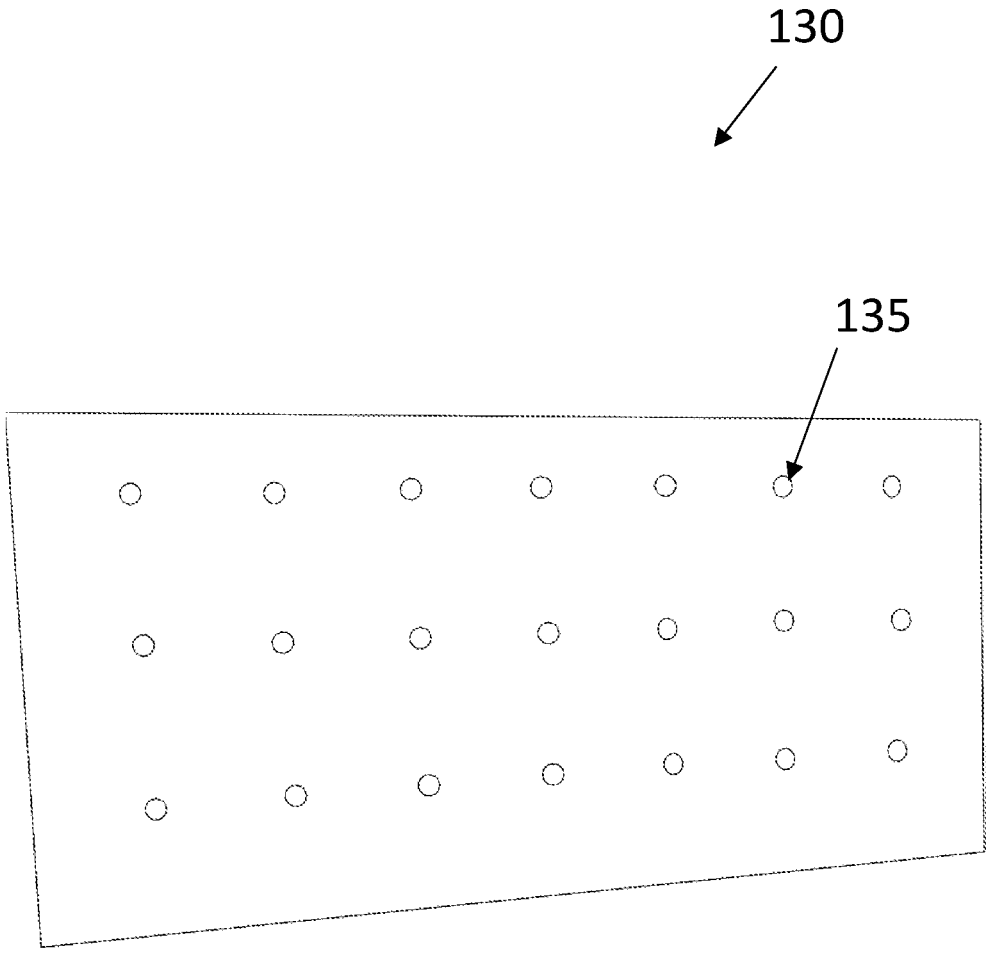
FIG. 4 shows the vent plate, according to an exemplary embodiment of the present invention.

The accompanying figures, which are incorporated herein, form part of the specification and illustrate embodiments of the present invention. Together with the description, the figures further explain the principles of the present invention and to enable a person skilled in the relevant arts to make and use the invention.

Disclosed are a lyophilization apparatus and a method for lyophilization that has shorted lyophilization lifecycle times and provide uniform sterilization in a batch lyophilization process. Referring to FIGS. 1-5, the disclosed lyophilization apparatus 100 can include a block 110, a sealing member 120, and a vent plate 130. The block 110 is separately shown in FIG. 2 and includes a rigid block made from any heat conductive material. The block can include wells 115 on the top side of the block, wherein the wells can have a predetermined depth from the top surface of the block. The containers containing the product to be lyophilized can fit into the wells. Preferably, the containers can close fit into the wells and the majority of the surface area of the containers can be in close contact with the wall of the wells. This may allow heat conduction from the block into the product through the container. Unlike the convention lyophilization process, wherein only the bottom of a container is in contact with a shelf for heat conduction, the well provides a large surface area for uniform heat conduction. Multiple wells receiving multiple containers can be evenly heated by the block resulting in an improved lyophilization process and shorter lyophilization life cycle times. The block can be stacked one above another which promotes the even distribution of heat to the entire product batch.

The containers can be any container known in the lyophilization process that includes the product for lyophilization. The containers can be made from glass, plastic, and like material known to a skilled person for use in a container suitable for lyophilization. The product can be a solution, such as liquid injectable biologic formations. In one implementation, the containers can be syringes, vials, ampules, and the like. Preferably, the container can be syringes in which the product can be directly lyophilized, and the syringes containing the lyophilized product can be packed. The syringes can be put into the wells, wherein most of the barrel portion of the syringes can be within the well and can be in contact with the walls of the well. The collar or flange of the syringe along a periphery of the barrel can be retained along a periphery of the well. The syringes are surrounded by highly conductive material. Because of the large surface area for heat conduction, the heating time is significantly reduced in comparison with convection and radiation. Accordingly, the lyophilization cycle times can be reduced. The blocks can bring heat more quickly and evenly to each syringe and over the entire batch. The blocks can be made of conductive materials, such as Aluminum that can tolerate the rigorous lyophilization environment. Lyophilization cycles can be shortened through the use of these novel design techniques, an extensive reconfiguration of sublimation area, and materials that promote the superior lyophilization characteristics of conduction over standard convection and radiation presently used on heated shelves.

In one implementation, the container can be a syringe. The barrel of the syringe can snugly fit into the wells such that to provide close contact with the walls of the block for heat conduction. While putting the syringes into the wells, the tip of the syringes can be capped and the opening of the barrel can remain open i.e., syringes without the plunger. The syringes can be inserted upright into the wells and remain upright for filling the solution to be lyophilized. The openings can be capped after filling the solution, such that to allow for venting during the lyophilization process. The flange of the barrel can rest against the periphery of the well. Once, the opening of the barrel can be capped, a sealing member, such as the silicone pad shown in FIG. 3, can be placed over the top surface of the block and the syringes. The silicone pad 120 has apertures 125 that act as a vent for the vapors. The location of these apertures or vents in the sealing member can coincide with the position of wells in the block when the top side of the block is covered with the sealing member. As shown in FIG. 1, a metal plate 130 can be placed above the sealing member and fastened sufficiently to prevent leakage from the syringes. The sealing member can be seen sandwiched between the metal plate and the block. The metal plate can also have apertures or vents 135 that coincide with the apertures in the sealing member and the wells in the block. The vapors can exhaust through the cap of the syringe and vents in the sealing member and the metal plate, and thereafter, the vapors can be removed by vacuum. It is understood that the apertures or vents can be replaced by any other means of venting known to a skilled person for use in lyophilization, and any such venting arrangement is within the scope of the present invention. For example, right-angle vents that fit into the open end of the syringe and then turn upward for venting. Also, the covering plate disclosed in US 9,003,676 B2, whereby Yarborough et al. placed a cover plate over a tray of syringes can be incorporated without departing from the scope of the present invention. The instant embodiment may use a device where the plate could be turned on its side as it embraces proximal open ends of syringes with protuberances. These protuberances may independently vent at a right angle then upward or it may vent into the cover plate with a built-in vent again exiting upward. Also is envisioned, protuberances fitting from a vertical cover plate which adheres by clips or otherwise fastens onto and thereby attaches to the block. Securing the plate in this fashion can prevent the leakage of solution from the syringe and allows for venting during lyophilization. Also envisioned is a lid-type device attached over the entire superior aspect of the block. The lid-type device can serve to vent each syringe while retaining the solution in the syringe.

In one implementation of the disclosed method for lyophilization, once the metal plate can be secured firmly, the apparatus can be is turned sidewards, such that the syringes turn from the upright or vertical position to a horizontal position. Because the syringes are placed horizontally, the solution inside the syringe has a larger surface area than the surface area of the solution in the upright position of the syringe. This is important because the critical process of sublimation initially takes place on the surface of the agent. If the syringe was vertical, then the surface area of the agent would be only as wide as the syringe barrel. As lyophilization continues, it takes place under the surface as it starts at the top and gradually reaches the bottom of the syringe. The horizontally positioned syringes have a wider footprint for sublimation. In addition, the syringe and solution in the syringe benefit from the Block being in total contact with the exterior of the syringe. Thus, the desired temperature can be reached quickly, and heat can be evenly conducted to the syringe from the block. This prevents the familiar and unavoidable situation, also known as the edge vial effect, where a typical pan of syringes would complete formation on the pan edges while the center has not reached product maturation. The disclosed apparatus and method allow the sublimation to take place along the entire length of the barrel of the syringe. In the horizontal position of the syringe, the molecules of the solution during the lyophilization process may travel only five millimeters vs sixty-five millimeters in the vertical position of the syringe. This horizontal placement of the container, and in particular, the syringes, widen the sublimation footprint and flattens the solution in the containers providing a shallower solution. The block configuration, the expanded sublimation footprint, and the shallow active agent solution provide a novel and accelerated method to optimize the lyophilization cycle. It is understood that although the aforesaid embodiment is described for syringes in the horizontal position, however, the steps of the method are applicable to other containers, where feasible, without departing from the scope of the present invention. Also, it is understood that the container can be tilted at any angle between the vertical and horizontal positions without departing from the scope of the present invention.

It is understood that the lyophilization apparatus can include other lyophilization techniques and hardware, including but not limited to vapor collection devices and/or vapor venting devices and the like known to a skilled person for use in lyophilization without departing from the scope of the present invention.

Figure 5:
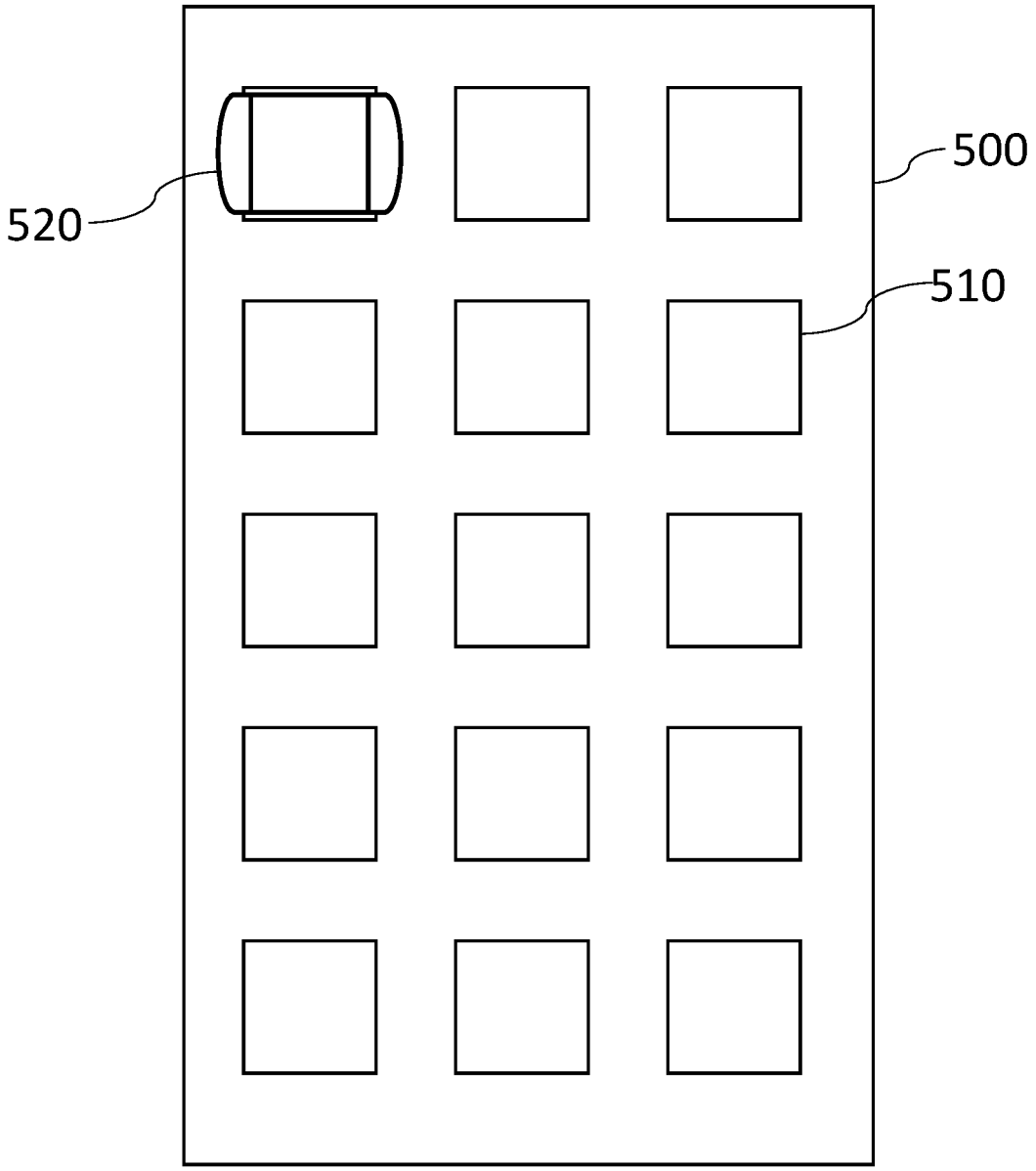
FIG. 5 is a top view of the block with square-shaped syringes in the square shape wells, according to an exemplary embodiment of the present invention.

Also, disclosed are containers that can closely fit into the wells of the block. Preferably, the containers can be syringes, however, other types of containers, such as vials are within the scope of the present invention. In one implementation, disclosed are syringes having square shape barrel and the block includes square shape well, such that the square shape syringes closely fit into the square shape wells. The square shape of the barrel provides a larger surface area for heat transfer by conduction from the block. Referring to FIG. 5 which shows a block 500 having three rows of square shape wells 510 and a square shape syringe 520 is also illustrated that is shown within a square well.

In one implementation, the disclosed lyophilization apparatus and method can make feasible the lyophilization of pharmaceutical products that are not considered lyophilization candidates because of lengthily protracted cycles. Such products can now be reevaluated with the prospect of enjoying well-known and valuable lyophilization benefits but are much shorter, more profitable cycles.

In one implementation, the block can be made in several layers, each layer made from a heat-conducting material. For this example, it is aluminum is economical and has largely acceptable and even preferred conduction properties. The layers can be hollowed out to accept the containers, in this case, syringes, in a firm tight fit. The layers are easy to use and are more convenient for use in the lab. With layers comprising a block or several blocks, they provide flexibility in structuring the configuration of a batch to reach the maximum accommodation of the lyophilizing production space.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. A method for lyophilization, the method comprising the steps of:

(a) providing a lyophilization apparatus comprising:

(i) a block made from a heat conductive material, said block having a plurality of wells of a predetermined depth, said plurality of wells being arranged on a top side of the block with each well of the plurality of wells being configured to receive a container, wherein said container can contain a product to be lyophilized, (ii) a sealing member configured to cover the top side of the block and the plurality of wells, said sealing member having a first venting mechanism configured to allow vapors to escape from the container placed in each well, and (iii) a metal plate configured to secure the sealing member to the block, wherein the metal plate has a second venting mechanism configured to allow the vapors received through the first mechanism to escape;

(b) placing an open-topped container in an upright position into each of the plurality of wells such that an opening provided in each container faces up;

(c) filling each container with a product to be lyophilized via said opening;

(d) closing the opening in each container with a respective cap, wherein each cap is configured to permit the vapors from its respective container to escape through the first venting mechanism and the second venting mechanism;

(e) placing the sealing member over the top side of the block thereby covering each of said containers; and (f) fastening the metal plate to the block such that the sealing member is sandwiched between the metal plate and the top side of the block.

2. The method according to claim 1, wherein the method further comprises the steps of:

(g) upon fastening the metal plate, turning the lyophilization apparatus sidewards so as to rotate each containers from the upright position to a horizontal position; and (h) transferring heat to said block while each of said containers is in the horizontal position, wherein the product to be lyophilized is a solution, further wherein the metal plate, the sealing member, the block, and each respective cap are configured such that none of said product leaks from its respective container while in the horizontal position.

3. The method according to claim 2, wherein each container is a syringe without a plunger, wherein the predetermined depth is such that the syringe is inserted into the well with a tip of the syringe facing downwards into the well and a flange of a barrel of the syringe resting against a periphery of the well.

* * * * *